US011583852B2

(12) United States Patent
Jones et al.

(10) Patent No.: US 11,583,852 B2
(45) Date of Patent: Feb. 21, 2023

(54) MICROFLUIDIC CONNECTION AND A CONNECTING INTERFACE FOR FLUIDICALLY INTERCONNECTING MICROFLUIDIC CHANNELS

(71) Applicant: miDiagnostics NV, Leuven (BE)

(72) Inventors: Benjamin Jones, Leuven (BE); Peter Peumans, Leuven (BE); Claus Marquordt, Leuven (BE); Remus Brix Anders Haupt, Leuven (BE)

(73) Assignee: miDiagnostics NV, Leuven (BE)

( * ) Notice: Subject to any disclaimer, the term of this patent is extended or adjusted under 35 U.S.C. 154(b) by 456 days.

(21) Appl. No.: 16/419,316

(22) Filed: May 22, 2019

(65) Prior Publication Data

US 2019/0358631 A1 Nov. 28, 2019

(30) Foreign Application Priority Data

May 23, 2018 (EP) ..... 18173872

(51) Int. Cl.
*B01L 3/00* (2006.01)

(52) U.S. Cl.
CPC ... *B01L 3/502715* (2013.01); *B01L 2200/027* (2013.01); *B01L 2300/08* (2013.01); *B01L 2300/0861* (2013.01)

(58) Field of Classification Search
CPC ..... B01L 3/502715; B01L 2200/027; B01L 2300/08; B01L 2300/0861; B01L 3/563; B01L 2300/0816
See application file for complete search history.

(56) References Cited

U.S. PATENT DOCUMENTS 6,106,685 A 8/2000 McBride et al.
2007/0048189 A1* 3/2007 Cox ..... B01L 3/5025 422/400
2008/0233011 A1 9/2008 Gundel et al.
(Continued)

FOREIGN PATENT DOCUMENTS

WO 2016122643 A1 8/2016

OTHER PUBLICATIONS

Van Heeren, H., et al., Design Guideline for Microfluidic Device and Component Interfaces (part 1), http://enablingmnt.com/wp-content/uploads/2018/01/Design-for-Microfluidic-Interfacing-White-Paper-part-1-version-3.pdf, Jun. 1, 2017, pp. 1-29.
(Continued)

*Primary Examiner* — Jennifer Wecker
*Assistant Examiner* — Oyeleye Alexander Alabi
(74) *Attorney, Agent, or Firm* — Hodgson Russ LLP

(57) ABSTRACT

There is provided a connecting interface for fluidically interconnecting microfluidic channels. The connecting interface comprises one or more substrates which collectively define a first microfluidic channel which includes a connecting region for fluidically connecting the first microfluidic channel to a second microfluidic channel. The connecting interface further comprises at least one slit in an outer surface of one of the one or more substrates, wherein the at least one slit provides a fluid passage from the outer surface to the connecting region of the first microfluidic channel, and the at least one slit has at least one dimension extending beyond the connecting region along a direction parallel to the outer surface.

21 Claims, 11 Drawing Sheets

(56) References Cited

U.S. PATENT DOCUMENTS

2008/0257754 A1* 10/2008 Pugia ..... B01L 3/502723
205/792
2018/0024155 A1* 1/2018 McGuinness ..... G01N 35/08
422/507

OTHER PUBLICATIONS

Dolomite Microfluidics, 6 Junction Droplet Chip (product datasheet), https://www.johnmorrisgroup.com/Content/Attachments/23515/6_junction_droplet_chip_product_datasheet.pdf, Jan. 15, 2013, pp. 1-10.

* cited by examiner

SECTION C-C

SECTION D-D

SECTION C-C

SECTION D-D

SECTION H-H

SECTION J-J

SECTION R-R

SECTION T-T

MICROFLUIDIC CONNECTION AND A CONNECTING INTERFACE FOR FLUIDICALLY INTERCONNECTING MICROFLUIDIC CHANNELS

CROSS-REFERENCE TO RELATED APPLICATIONS

This application claims priority to European Patent Application No. EP 18173872.5, filed on May 23, 2018, the disclosure of which is incorporated herein by reference.

TECHNICAL FIELD

This disclosure relates to interconnection of microfluidic channels. In particular, it relates to a connecting interface for fluidically interconnecting microfluidic channels, a microfluidic connection, and a diagnostic device including such a connecting interface or microfluidic connection.

BACKGROUND

Microfluidics deals with the behavior, precise control and manipulation of fluids that are geometrically constrained to a small, typically sub-millimeter, scale. Technology based on microfluidics are used for example in ink-jet printer heads, DNA chips and within lab-on-a-chip technology. In microfluidic applications, fluids are typically moved, mixed, separated or otherwise processed. In many applications, passive fluid control is used. This may be realized by utilizing the capillary forces that arise within sub-millimeter tubes. By careful engineering of a so called capillary driven fluidic system, it may be possible to perform control and manipulation of fluids.

Microfluidic substrates may be designed for different purposes, and it is often desirable to interconnect different microfluidic substrates to form part of a microfluidic system. For example, a second microfluidic chip may be arranged on top of a cover of a first microfluidic chip, and the first and the second microfluidic chip may be fluidically connected via a through-hole in the cover. However, such a connection, referred to herein as a through-hole connection, has several drawbacks. Firstly, it is sensitive to misalignments of the microfluidic chips to be interconnected. Secondly, fluid will accumulate in the volume of the through-hole and hence reduce the fluid volume passed from the second chip to the first chip and vice versa. There is thus a need for improvements.

SUMMARY

Example embodiments provide a connecting interface for fluidically interconnecting microfluidic channels. The connecting interface comprises one or more substrates which collectively define a first microfluidic channel which includes a connecting region for fluidically connecting the first microfluidic channel to a second microfluidic channel. The connecting interface further comprises at least one slit in an outer surface of one of the one or more substrates, wherein the at least one slit provides a fluid passage from the outer surface to the connecting region of the first microfluidic channel, and the at least one slit has at least one dimension extending beyond the connecting region along a direction parallel to the outer surface.

BRIEF DESCRIPTIONS OF THE DRAWINGS

The above, as well as additional objects, features and advantages, will be better understood through the following illustrative and non-limiting detailed description of embodiments described herein, with reference to the appended drawings, where the same reference numerals will be used for similar elements, wherein.

DETAILED DESCRIPTION

I. Overview

Figure 1A:
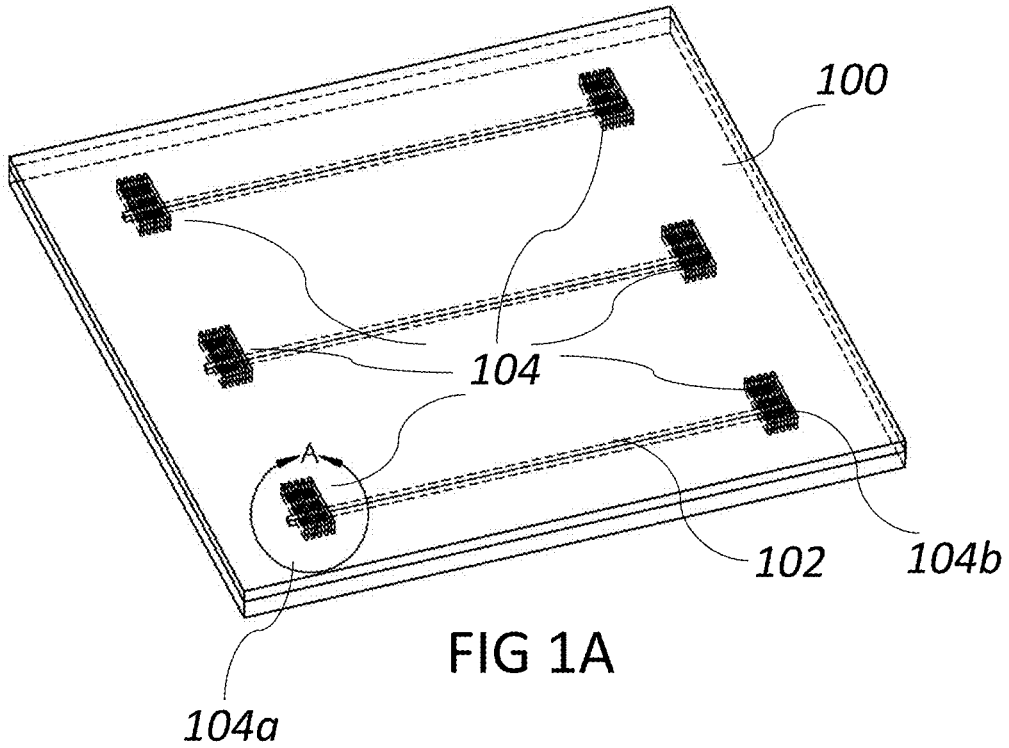
FIG. 1A is a perspective view of a first fluidic device according to embodiments.

It is an object to mitigate the drawbacks mentioned above and provide an improved connection between two microfluidic channels.

According to a first aspect, example embodiments provide a connecting interface for fluidically interconnecting microfluidic channels, the connecting interface comprising one or more substrates which collectively define a first microfluidic channel which includes a connecting region for fluidically connecting the first microfluidic channel to a second microfluidic channel, and at least one slit in an outer surface of one of the one or more substrates, wherein the at least one slit provides a fluid passage from the outer surface to the connecting region of the first microfluidic channel, and the at least one slit has at least one dimension extending beyond the connecting region along a direction parallel to the outer surface.

With this connecting interface, at least one slit is provided to establish a fluid passage from the outer surface to a connecting region of the first microfluidic channel. Since the at least one slit extends outside the connecting region of the microfluidic channel, the connecting interface is less sensitive to misalignments than a conventional through-hole connection. More specifically, a second microfluidic channel may be connected to the first microfluidic channel via the connection interface even if it is not perfectly aligned with the first microfluidic channel. It is enough that the second microfluidic channel overlaps with the at least one slit in the outer surface of the connecting interface. The at least one slit thus serves as an additional alignment tolerance since it extends outside the connecting region.

A further advantage is that the at least one slit, due to its long and narrow shape, for a given alignment tolerance between mating microfluidic chips, has a reduced volume compared to a conventional through-hole connection. Accordingly, the fluid that is accumulated in the at least one slit is reduced compared to a conventional through-hole connection.

By a connecting region of a microfluidic channel is generally meant a region or portion of the microfluidic channel to be connected to another microfluidic channel. The connection may be an inlet, meaning that fluid is to be connected in to the microfluidic channel at the connecting region, or an outlet, meaning that fluid is to be connected out from the microfluidic channel at the connecting region.

The first microfluidic channel and the at least one slit may be provided in different substrates. This is advantageous since it simplifies the fabrication of the connecting interface. More specifically, the one or more substrates may comprise a first substrate which includes the first microfluidic channel, wherein the connecting region of the first microfluidic channel is arranged in a first surface of the first substrate, and a second substrate being arranged on the first surface, wherein said at least one slit is arranged in an outer surface of the second substrate to provide a fluid passage between the outer surface of the second substrate to the connecting region of the first microfluidic channel in the first substrate.

Alternatively, the first microfluidic channel and the at least one slit may be defined in the same substrate. For example, the first microfluidic channel and the at least one slit may be defined in opposite sides of the same substrate.

The at least one slit may be a plurality of slits. By having a plurality of slits, the sensitivity to misalignment is further reduced. Having a plurality of slits may also reduce the flow resistance at the connection.

The plurality of slits may be arranged in parallel.

A longitudinal direction of the at least one slit may be parallel to longitudinal direction of the first microfluidic channel at the connecting region. In this way, the at least one slit serves as an extension of the first microfluidic channel, thereby making the microfluidic connection less sensitive to misalignments in the longitudinal direction of the first microfluidic channel. The longitudinal direction of the first microfluidic channel corresponds to the direction of flow in the first microfluidic channel.

A longitudinal direction of the at least one slit may form an angle in relation to a longitudinal of the first microfluidic channel at the connecting region. For example, the at least one slit may be orthogonal, or arranged at any other angle, to the first microfluidic channel. This makes the microfluidic connection less sensitive to misalignments in directions which forms an angle with respect to the first microfluidic channel.

According to example embodiments, the first microfluidic channel may be branched into a plurality of sub-channels, wherein the connection region is defined by an intersection between the at least one slit and the plurality of sub-channels. The sub-channels may be arranged in parallel. This serves to reduce the flow resistance of the connection and allows for further misalignments of the second microfluidic channel with respect to the first microfluidic channel.

In such embodiments, there may be a plurality of slits in the outer surface, and each sub-channel of the plurality of sub-channels may be associated with a respective slit which provides a fluid passage between the outer surface and the sub-channel and which extends in a direction parallel to a longitudinal direction of the sub-channel. Alternatively, there may be a plurality of slits in the outer surface, and each slit may extend across each one of the plurality of sub-channels.

Instead of being arranged in parallel, the plurality of slits may extend beyond the connecting region along radial directions in relation to a center of the connecting region. In that way, the connection becomes less sensitive to misalignments in several, radial, directions. For example, the connecting region may have a circular shape in a cross-section parallel to the outer surface, and the plurality of slits may each extend beyond the circular shape along one of the radial directions.

The first microfluidic channel may include a closed end, wherein the connecting region is arranged at the closed end. The first microfluidic channel may hence be connected to a second microfluidic channel at a closed end.

The first microfluidic channel may form a chamber at the connecting region. More specifically, a portion of the first microfluidic channel may have a first width and a another portion of the first microfluidic channel outside the connecting region may have a second, smaller, width, such that the first microfluidic channel forms a chamber at the connection region. This may serve to reduce the flow resistance at the connection.

The connecting region may include a micropillar array. For example, a micropillar array may be arranged in the chamber mentioned above. A micropillar array serves to reduce the flow resistance at the connection while promoting strong capillary forces. A micropillar array may be used as an alternative to the sub-channels discussed above.

The slits may have various shapes. For example, the at least one slit may have an elongated shape. A longitudinal direction of the at least one slit may be parallel to the outer surface. In particular, the at least one slit may be straight. In other examples, the at least one slit may be curved along the outer surface. Different shapes of the slits may have different advantages when it comes to reducing the sensitivity to misalignments and to reduce the flow resistance at the connection.

According to a second aspect, example embodiments provide a microfluidic connection for fluidically interconnecting microfluidic channels, the microfluidic connection comprising the connecting interface according to the first aspect, and a further substrate including a second microfluidic channel arranged at said outer surface to intersect said at least one slit for fluidically connecting the second microfluidic channel to the first microfluidic channel.

The microfluidic connection may further comprise an adhesive layer arranged between said outer surface and the further substrate, wherein the adhesive layer has an opening overlapping at least a portion of the at least one slit in the outer surface for fluidically connecting the first microfluidic channel to the second microfluidic channel.

According to a third aspect, example embodiments provide a diagnostic device comprising the connecting interface according to the first aspect or the microfluidic connection according to the second aspect. The diagnostic device may be a device for detection of cells, proteins, small molecules and genetic material from body fluids.

The second and third aspects may generally have the same features and advantages as the first aspect. It is further noted that the inventive concept relates to all possible combinations of features unless explicitly stated otherwise.

II. Example Embodiments

Example embodiments will now be described more fully hereinafter with reference to the accompanying drawings. The inventive concepts may, however, be embodied in many different forms and should not be construed as limited to the embodiments set forth herein; rather, these embodiments are provided for thoroughness and completeness, and fully convey the scope of the inventive concepts to the skilled person.

FIG. 1A illustrates a microfluidic device 100. The microfluidic device 100 may comprise a microfluidic circuit. The microfluidic circuit may comprise various microfluidic components, including microfluidic channels, valves, flow resistors etc. The microfluidic components may be structures formed in a substrate, such as in a plastic, glass, or silicon. The illustrated microfluidic device 100 comprises a first microfluidic channel 102. The microfluidic channel 102 may be a capillary channel.

Figure 1B:
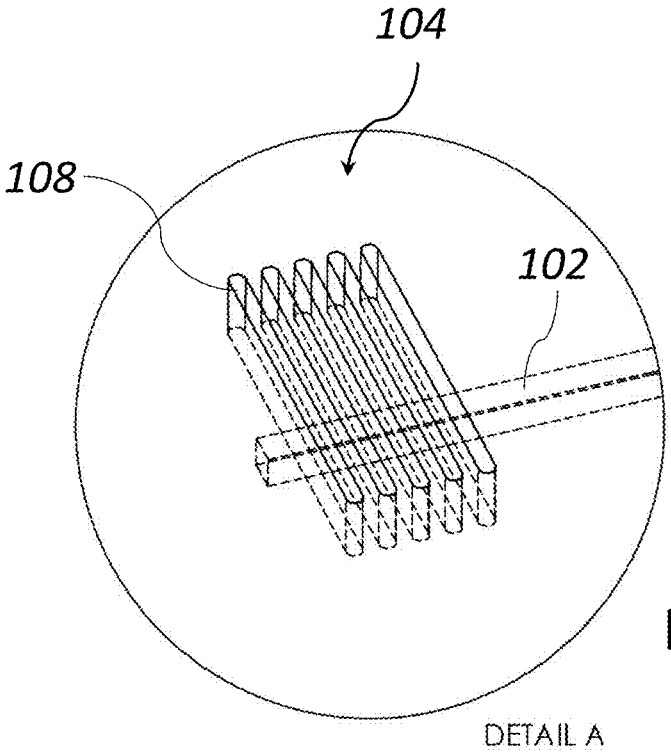
FIG. 1B illustrates the detail A shown in FIG. 1A.

The microfluidic device 100 further comprises an interface 104 for connecting the microfluidic device 100 to another microfluidic device. In particular, the interface 104 may be used to connect the first microfluidic channel 102 to a second microfluidic channel of the other microfluidic device. The interface 104 is arranged along the first microfluidic channel 102 at a region or portion thereof where it is to be connected to the second microfluidic channel. That region or portion is referred to herein as the "connecting region". As illustrated, the microfluidic device 100 may comprise several connecting interfaces 104. For example, connecting interface 104*a* may be used to couple in a second microfluidic channel to the first microfluidic channel 102, while connecting interface 104*b* may be used to couple out the first microfluidic channel 102 to a third microfluidic channel. The connecting interface 104 may hence serve as an inlet to the first microfluidic channel 102 or as an outlet from the first microfluidic channel 102. The connecting interface 104 is schematically illustrated in FIG. 1B. The connecting interface 104 comprises the first microfluidic channel 102 and at least one slit 108. The connecting region 110 may be defined as the intersection between the first microfluidic channel 102 and the at least one slit 108. As will be described in the following, the connecting interface 104 may be embodied in many different ways.

Figure 1C:
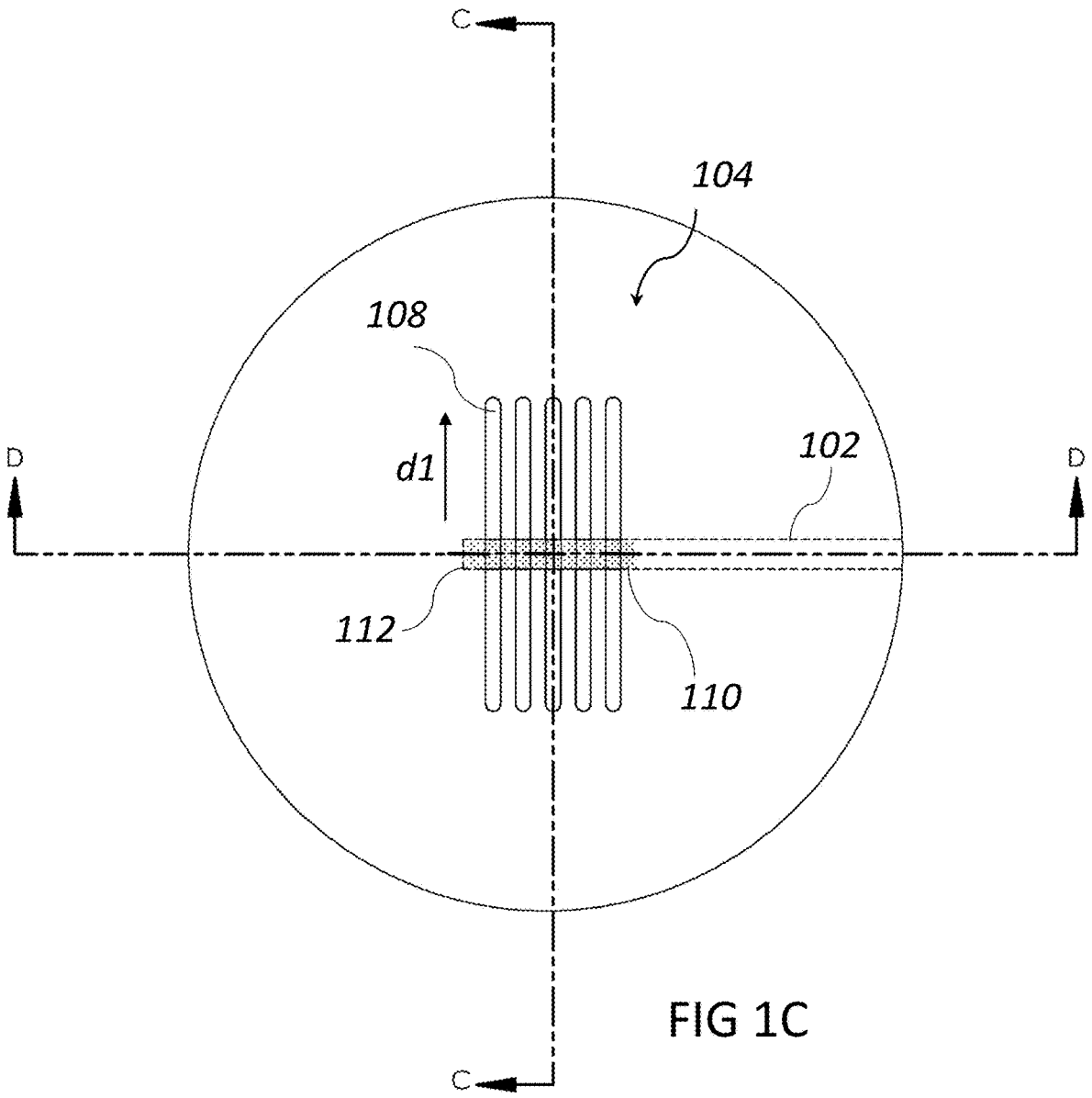
FIG. 1C is a top view of the connecting interface of FIG. 1B.

FIG. 1C shows a top view of the connecting interface 104. The first microfluidic channel 102 has a connecting region 110 (shown with a dotted pattern) where the first fluidic channel 102 is to be coupled to a second microfluidic channel. In the illustrated embodiment, the first microfluidic channel 102 has a closed end 112, and the connecting region is 110 is arranged at the closed end 112. However, it is to be understood that the connecting region 110 may be arranged anywhere along the first microfluidic channel 102. This applies to all embodiments shown herein.

The at least one slit 108, here shown as a plurality of slits arranged in parallel, extends beyond the connecting region 110 along the direction d1. In this way, the connecting interface 104 becomes less sensitive to misalignments when the first microfluidic device 100 is connected to another microfluidic device. As an example, the dimensions of the slit 108 may be on the order of 0.1 mm in width, 0.1 mm in depth and 1 mm in length and the length of the connecting region 110 may be on the order of 1 mm. In the shown embodiment five slits are shown which are arranged perpendicularly to a longitudinal direction of the first microfluidic channel 102. However, it is to be understood that any number of slits (including a single slit) arranged at any angle in relation to the first microfluidic channel 102 may be used. This includes slits arranged in parallel with the longitudinal direction of the first microfluidic channel 102, arranged perpendicularly to the longitudinal direction of the first microfluidic channel 102, and any angle in between.

Figure 1D:
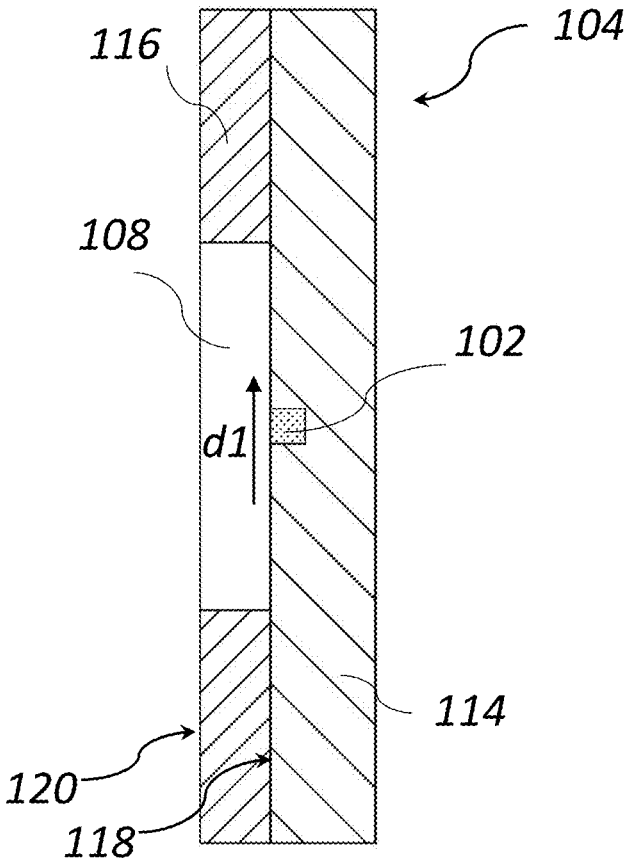
FIG. 1D is a cross-sectional view along section C-C of the connecting interface of FIG. 1C according to a first group of embodiments.
Figure 1E:
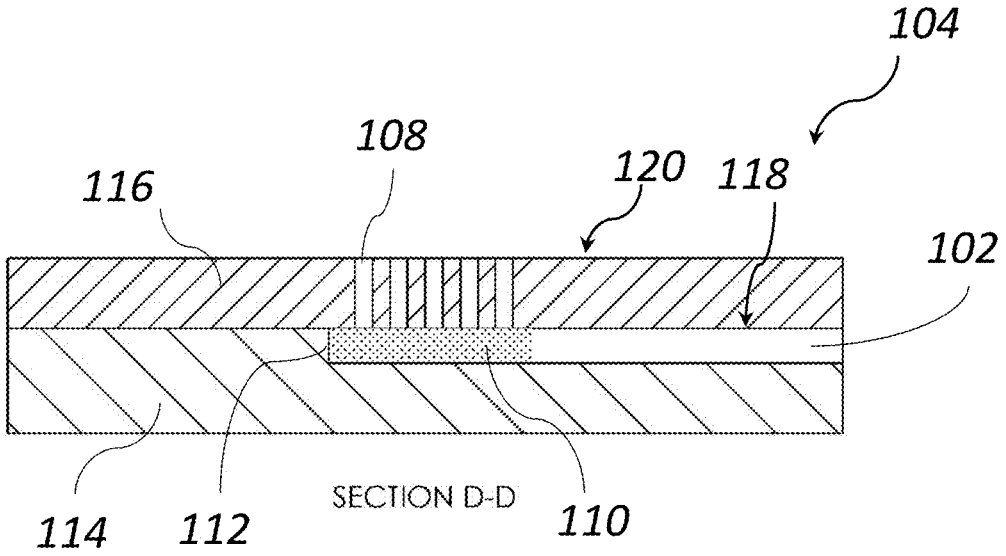
FIG. 1E is a cross-sectional view along section D-D of the connecting interface of FIG. 1C according to a first group of embodiments.

The connecting interface 104 may be defined in one or more substrates. As shown in FIGS. 1D and 1E, which are cross-sections along the lines C-C and D-D of FIG. 1C, respectively, the first microfluidic channel 102 may be defined in a first substrate 114, while the at least one slit 108 may be defined in a second substrate 116. The second substrate 116 may be arranged on a first surface 118 of the first substrate 114 so as to form a lid or cover of the first substrate 114. The first microfluidic channel 102 may be imbedded in the first substrate 114. In particular, the first microfluidic channel 102 may be formed in the first surface 118. The at least one slit 108 is formed in an outer surface 120 of the second substrate 116. The outer surface 120 is opposite to the surface of the second substrate 116 facing the first surface 118. The at least one slit 108 forms a through-hole through the second substrate 116 extending from the outer surface 120 to the connecting region 110 of the first microfluidic channel 102 defined in the first surface 118. The at least one slit 108 hence provides a fluid passage from the outer surface 120 to the connecting region 110. As is evident from FIG. 1D, the at least one slit 108 extends beyond the connecting region 110 of the first microfluidic channel 102 along direction d1 which is parallel to the outer surface 120.

The first and the second substrate 114, 116 may be made of a variety of materials, such as silicon, glass, plastic, metal, etc. The first microfluidic channel 102 and the at least one slit 108 may be fabricated in the first and the second substrates using a suitable processing technique such as by chemical etching or mechanically by machining. This applies to all embodiments shown herein.

Figure 1F:
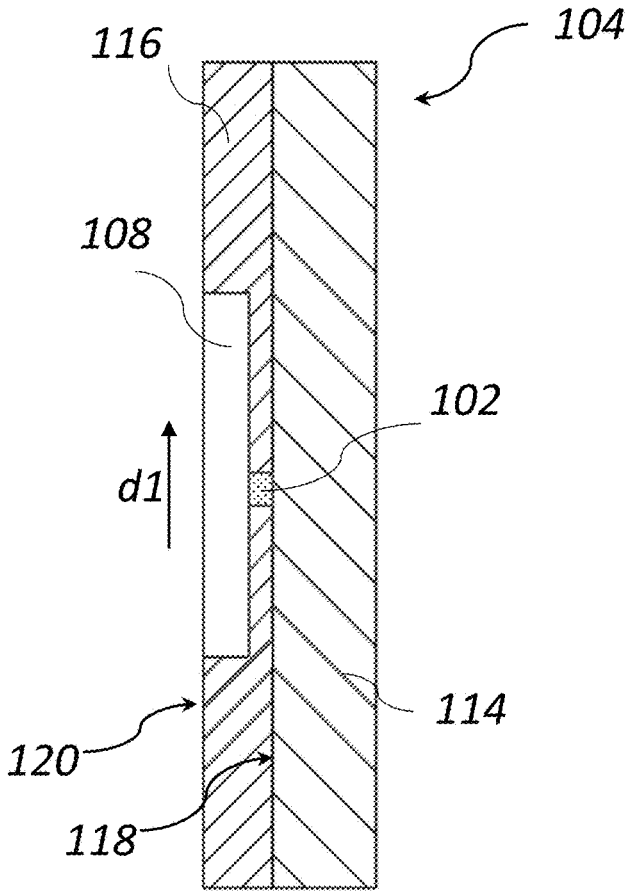
FIG. 1F is a cross-sectional view along section C-C of the connecting interface of FIG. 1C according to a second group of embodiments.
Figure 1G:
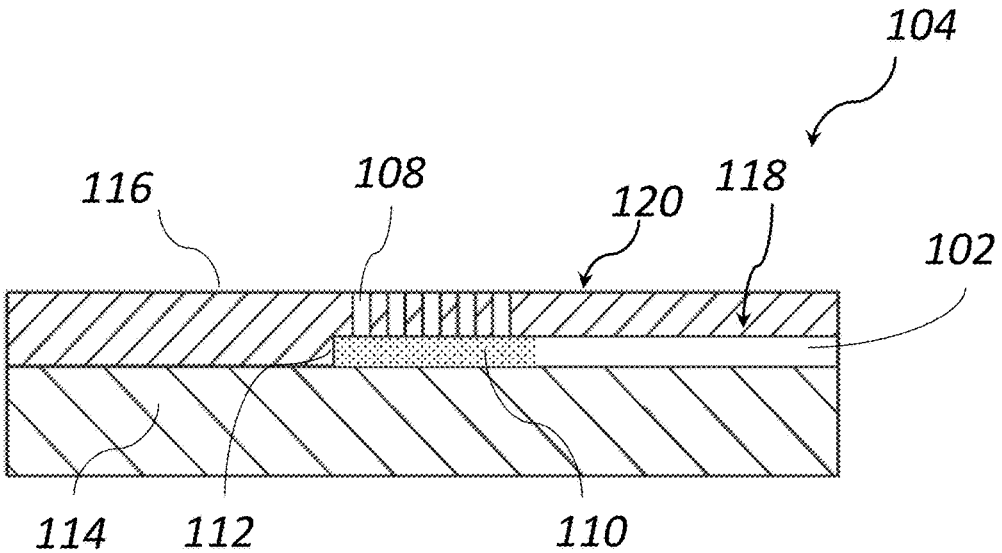
FIG. 1G is a cross-sectional view along section D-D of the connecting interface of FIG. 1C according to a second group of embodiments.

The first microfluidic channel 102 and the at least one slit 108 may also be defined on the same substrate. Such an embodiment is illustrated in FIGS. 1F and 1G, which are cross-sections along the lines C-C and D-D of FIG. 1C. As shown, both the first microfluidic channel 102 and the at least one slit 108 are defined in the second substrate 116. The first substrate 114 serves as a base for the second substrate 116. The at least one slit 108 and the first microfluidic channel 102 are arranged in opposite surfaces of the second substrate 116. More specifically, the at least one slit 108 is arranged in the outer surface 120, and the first microfluidic channel 102 is arranged in the surface facing the first surface 118 of the first substrate 114. In the following, the illustrated embodiments will be shown as being defined in two substrates, similarly to the embodiment of FIGS. 1D and 1E. However, it is understood that an implementation where the first microfluidic channel 102 and the at least one slit 108 are defined in the same substrate are equally possible.

Figure 2A:
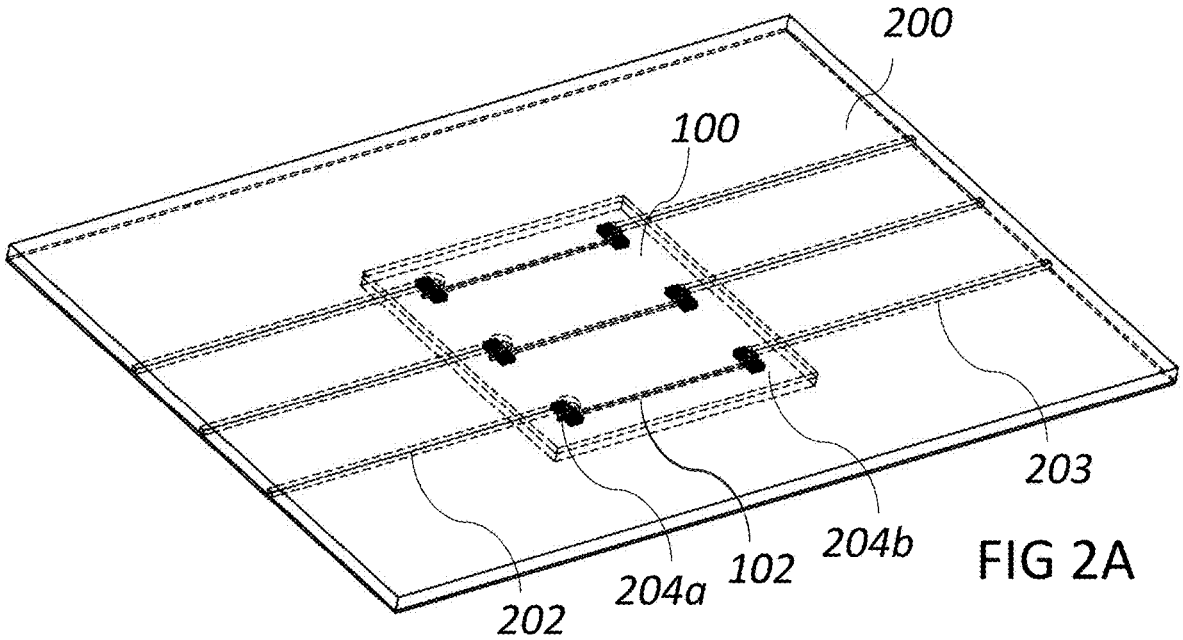
FIG. 2A is a perspective view of a connection between microfluidic channels of a first fluidic device and a second fluidic device according to embodiments.

FIG. 2A illustrates a microfluidic connection between a first microfluidic device 100 and a second microfluidic device 200 arranged on the first microfluidic device 100. The second microfluidic device 200 includes a second microfluidic channel 202. In the illustrated embodiment, the second microfluidic channel 202 is to be coupled into the first microfluidic channel 102. The illustrated second microfluidic device 200 further includes a third microfluidic channel 203 to which the first microfluidic channel 102 is to be coupled out. The microfluidic connection includes a first interconnection comprising a first connecting interface 204*a* for interconnecting the second microfluidic channel 202 and the first microfluidic channel 102. The microfluidic connection further includes a second interconnection comprising a second connecting interface 204*b* for interconnecting the first microfluidic channel 102 and the third microfluidic channel 203. Each of the connecting interfaces 204*a* and 204*b* may generally correspond to the connecting interface 104 described above, or to any of the connecting interfaces to be described below.

Figure 2B:
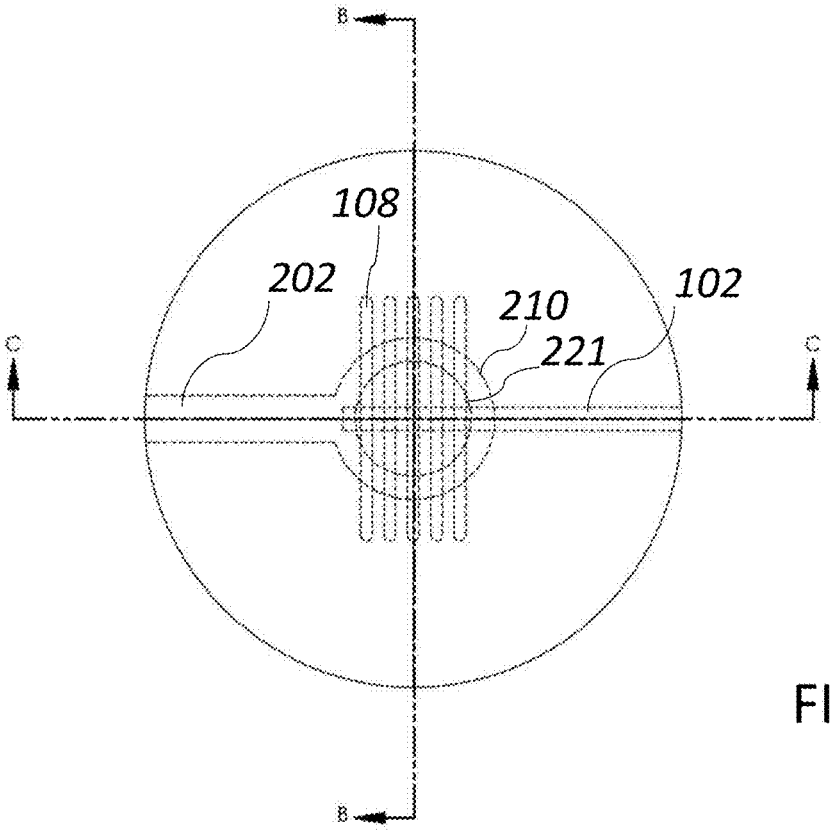
FIG. 2B is a top view of the connection of FIG. 2A at a first connecting interface of the connection according to embodiments.
Figure 2C:
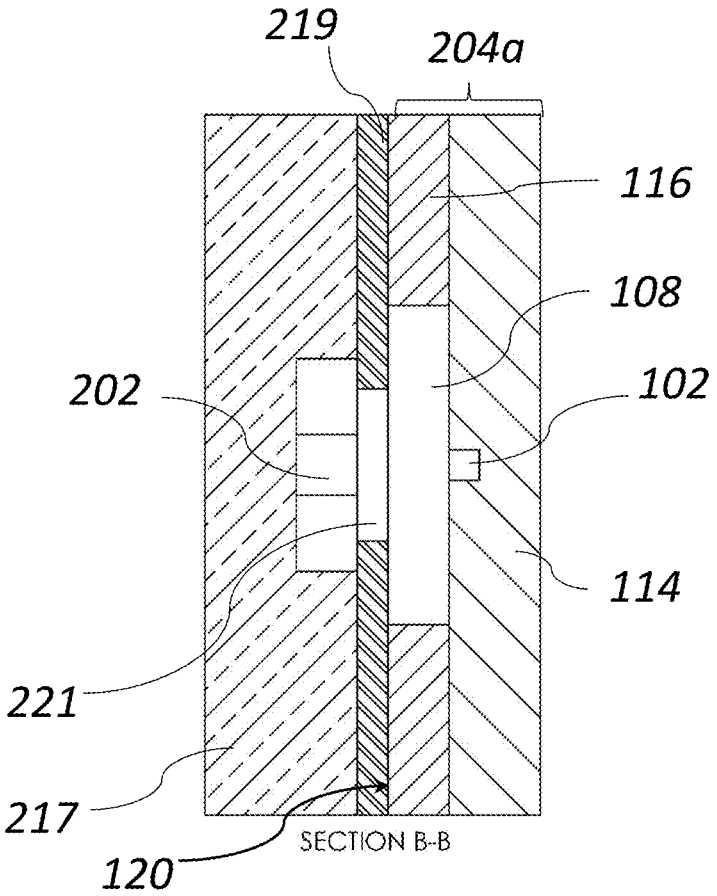
FIG. 2C is a cross-sectional view along section B-B of the connection of FIG. 2B according to embodiments.
Figure 2D:
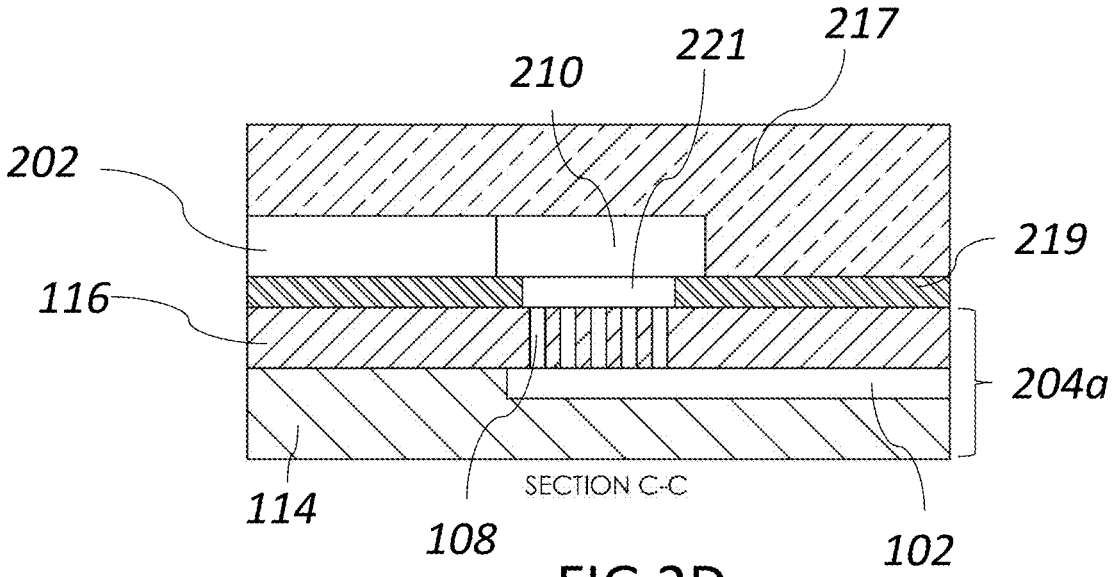
FIG. 2D is a cross-sectional view along section C-C of the connection of FIG. 2B according to embodiments.

A top view and cross-sections of the microfluidic connection at the first connecting interface 204*a* are shown in FIGS. 2B-2D. The first microfluidic device 100 comprises a first substrate 114 and a second substrate 116 which define the first microfluidic channel 102 and the at least one slit 108 as explained above. The second microfluidic device 200 comprises a third substrate 217 which is attached to first device 100 at the outer surface 120 of the second substrate 116. The second channel 202 is defined in the third substrate 217 in the surface facing the second substrate 116. Similar to the first and second substrates, the third substrate 217 may also be made of a variety of materials, such as silicon, glass, plastic, metal, etc. The second microfluidic channel 202 comprises a connecting region 210. The second microfluidic channel 202 may be wider at the connection region than outside the connecting region. In this way, the second microfluidic channel 202 may form a chamber at a portion where it is to be connected to the first microfluidic channel 102. The function of the chamber is to reduce flow resistance and, in the case of capillary-driven flow, to facilitate fluid transfer from the second channel 202 into the first channel 102. In the case of pressure-driven flow, the chamber or of the wider portion of channel 202 may not be needed. As shown in FIG. 2B the connecting region 210 may have a circular shape.

The second device 200 may be bonded to the first device 100 in a number of different ways, such as by using adhesive films, tapes, or glues, but may also be thermally bonded, soldered or welded. The embodiment shown in FIGS. 2B-2D includes an adhesive layer 219 which is being used to bond the third substrate 217 to the second substrate 116. The adhesive layer may be a double-sided adhesive tape, a layer of glue, or an adhesive film. The adhesive layer 219 has an opening 221 which overlaps both the connecting region 210 of the second microfluidic channel 202 and the at least one slit 108. The opening 221 thus defines a through-hole in the adhesive layer 219 allowing fluid to pass from the second microfluidic channel 202 to the first microfluidic channel 102. For capillary-driven flow, it is generally advisable to flow from a bigger section to a smaller section when transferring fluids from one microfluidic device to another. Flowing from a smaller section to a bigger section is generally inadvisable since this may promote pinning of the liquid-vapor interface and flow stoppage. This restriction need not apply to pressure-driven microfluidic systems. Thus, for a capillary-driven system, when the connection represents an inlet, such as at the first connecting interface 204*a*, the opening 221 in the adhesive layer 219 is typically smaller than the connecting region 210 of the second microfluidic channel 202. In other words, the connecting region 210 extends outside of the opening 221 in a plane parallel to the outer surface 120. When the connection represents an outlet of a capillary-driven system, such as at the second connecting interface 204*b*, the opening 221 in the adhesive layer 219 is instead typically larger than a connecting region of the third microfluidic channel 203. In other words, in that case the opening 221 in the adhesive layer 219 instead extends outside of the connecting region 210 in a plane parallel to the outer surface 120.

Figure 3A:
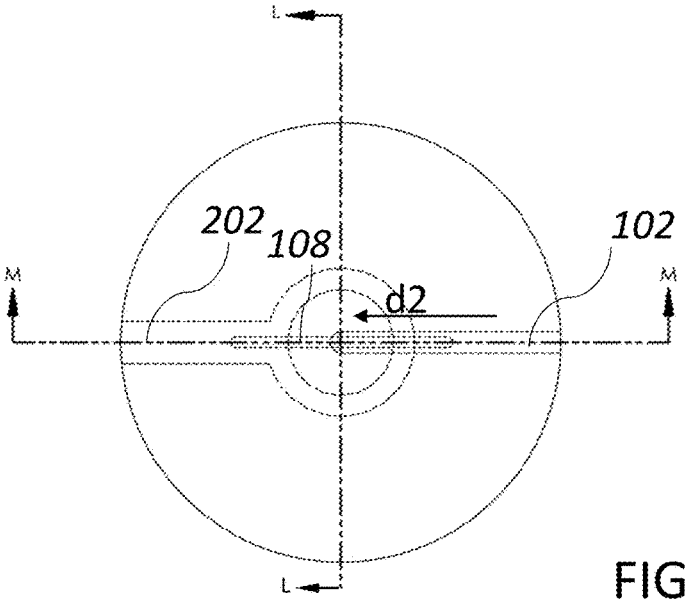
FIG. 3A is a top view of a connection between microfluidic channels of a first a first fluidic device and a second fluidic device at a first connecting interface according to embodiments.
Figure 3B:
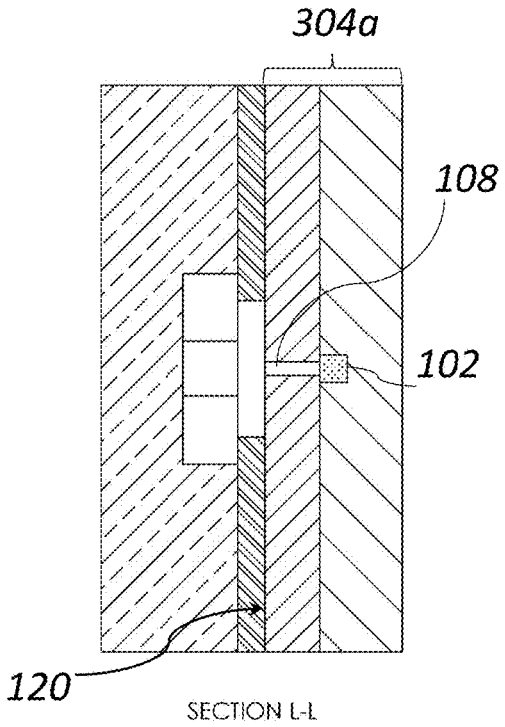
FIG. 3B is a cross-sectional view along section L-L of the connection of FIG. 3A according to embodiments.
Figure 3C:
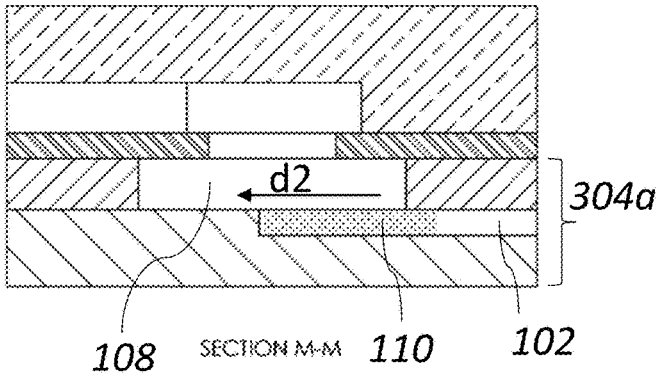
FIG. 3C is a cross-sectional view along section M-M of the connection of FIG. 3A according to embodiments.

As discussed, the at least one slit 108 may be arranged to form an angle with respect to a longitudinal direction or extension of the first microfluidic channel 102. However, embodiments where the at least one slit is arranged in line with the first microfluidic channel 102 are also possible. FIGS. 3A-3C illustrate a connection where the second microfluidic channel 202 is coupled into the first microfluidic channel 102. The connecting interface 304*a* in this case includes a single slit 108 which is arranged in line with the first microfluidic channel 102. The slit 108 thus extends in a direction d2 along the outer surface 120 which is parallel to a longitudinal direction of the first microfluidic channel 102 at the connecting region 110. The advantage of the parallel arrangement of the slit 108 relative to the first microfluidic channel 102 compared to the previously described embodiments is, for capillary-driven flow with certain fluid/surface combinations, fluid may be more easily transferred from channel 102 to slit 108 without stoppage of the liquid. The drawback of the parallel arrangement relative to previously described embodiments is that a tighter positioning tolerance is required to align the slit 108 with the channel 102.

FIGS. 4A-4C and FIGS. 5A-5C illustrate embodiments of a connecting interface 404*a*, 504*a* where the first microfluidic channel 102 is provided with a header 401 in the connecting region. The header 401 is used to branch the first microfluidic channel 102 into a plurality of sub-channels 402*a-d*. The sub-channels 402*a-d* are here arranged in parallel. The header 401 serves to distribute the flow in the first microfluidic channel 102 to the sub-channels 402*a-d*, or vice versa depending on the flow direction. The use of the header 401 reduces the flow resistance at the connecting interface.

Figure 4A:
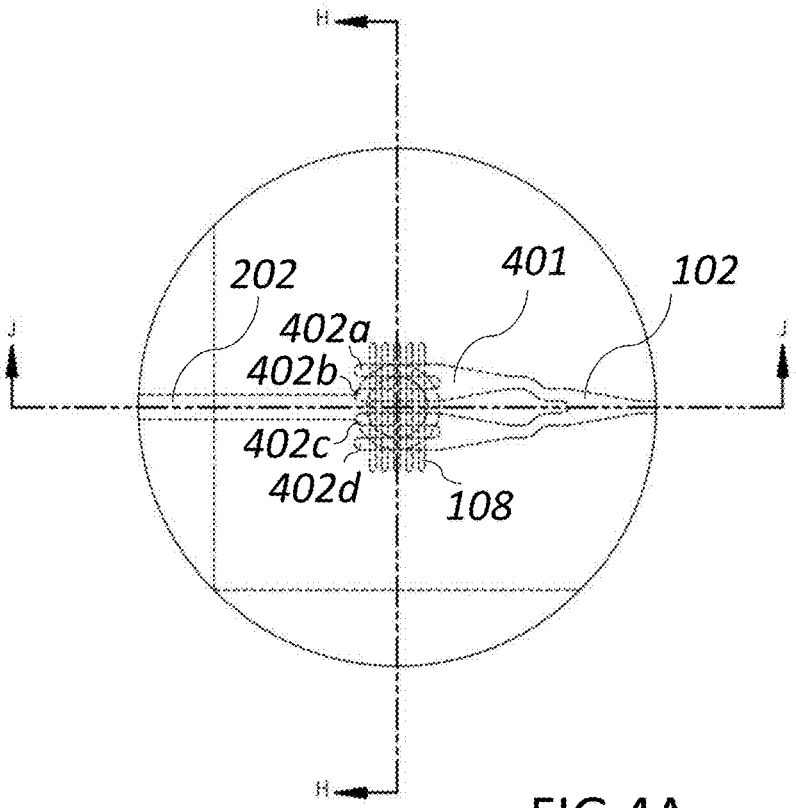
FIG. 4A is a top view of a connection between microfluidic channels of a first fluidic device and a second fluidic device at a first connecting interface according to embodiments.
Figure 4B:
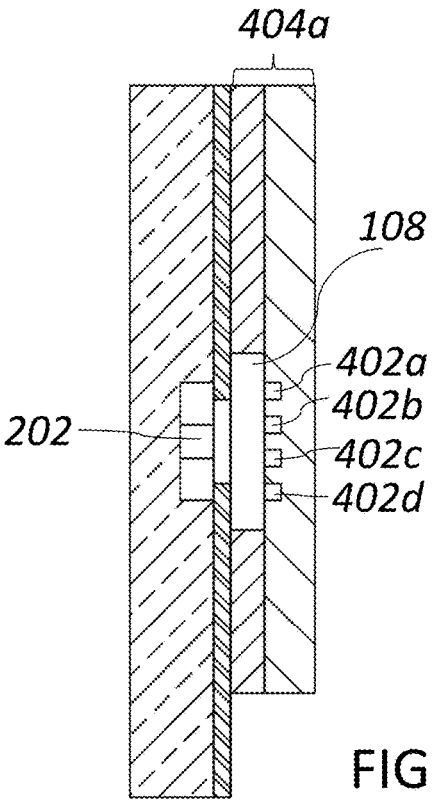
FIG. 4B is a cross-sectional view along section H-H of the connection of FIG. 4A according to embodiments.
Figure 4C:
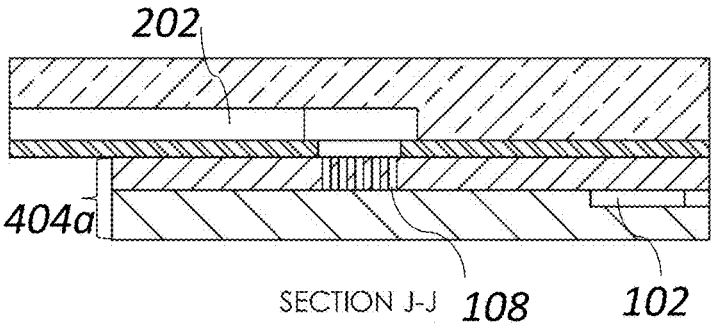
FIG. 4C is a cross-sectional view along section J-J of the connection of FIG. 4A according to embodiments.

In FIGS. 4A-4C, the connecting interface 404*a* includes a plurality of slits 108 which are arranged in parallel. Each of the slits extends across each one of the plurality of sub-channels 402*a-d*. As a second microfluidic channel 202 is coupled into the connecting interface 404*a*, fluid from the second microfluidic channel 202 is thereby allowed to flow into each of the plurality of sub-channels 402*a-d*. The plurality of sub-channels reduces the flow resistance of the connecting interface and provides redundancy to improve reliability in the fluidic connection. Although the plurality of slits 108 are shown to be perpendicular to the direction of flow in the first microfluidic channel 102, it is to be understood that the plurality of slits 108 may be arranged at any angle to the direction of flow.

Figure 5A:
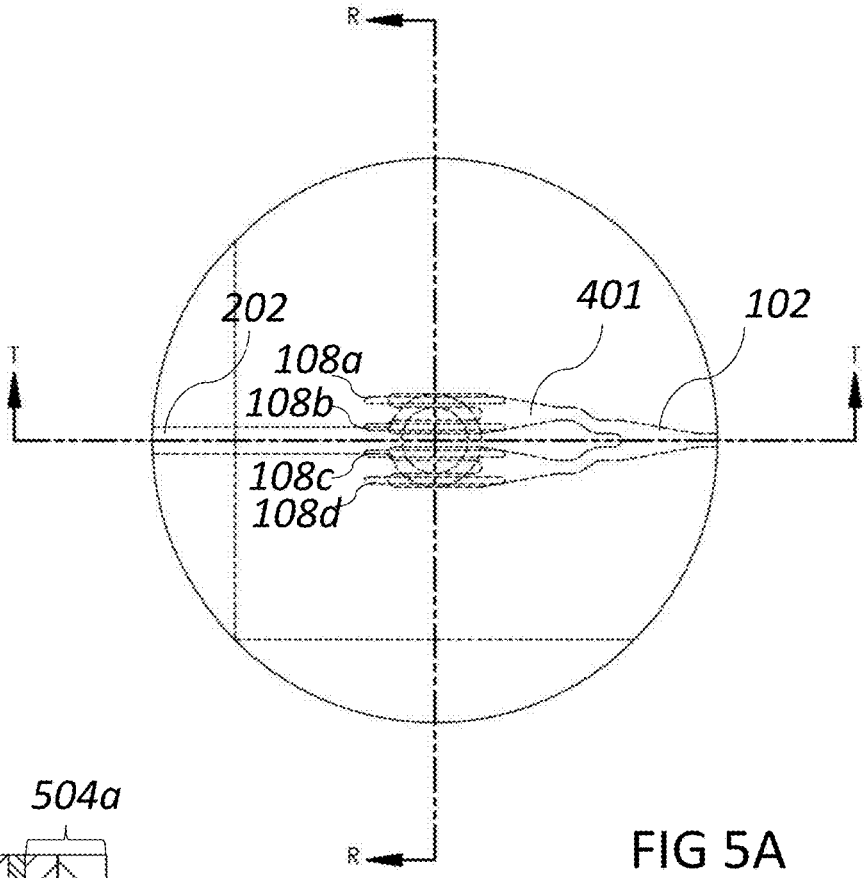
FIG. 5A is a top view of a connection between a first a first fluidic device and a second fluidic device at a first connecting interface according to embodiments.
Figure 5B:
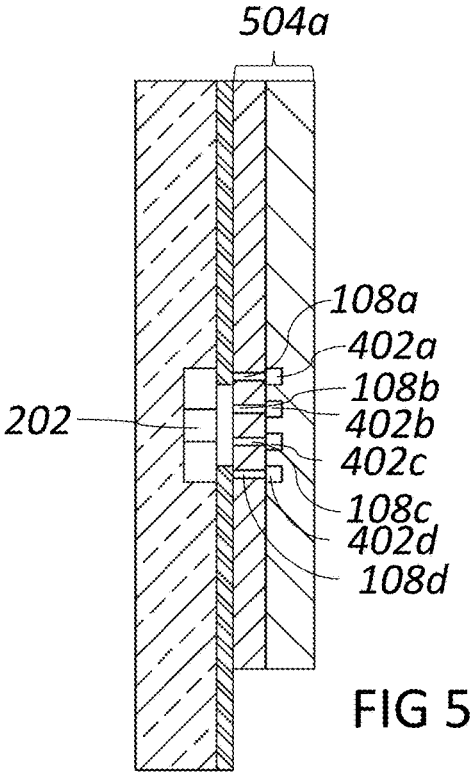
FIG. 5B is a cross-sectional view along section R-R of the connection of FIG. 5A according to embodiments.
Figure 5C:
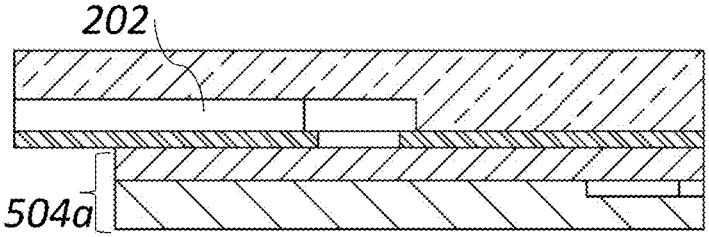
FIG. 5C is a cross-sectional view along section T-T of the connection of FIG. 5A according to embodiments.

In FIGS. 5A-5C, the connecting interface 504*a* includes a plurality of slits 108 which are arranged in parallel. However, the connecting interface 504*a* differs from the connecting interface 404*a* of FIGS. 4A-4C in that the plurality of slits 108 are arranged in line with the sub-channels. Each sub-channel 402*a-d* is hence associated with a respective slit 108*a-d* which is arranged in line with the sub-channel 402*a-d*. Each slit 108*a-d* hence extends in a direction parallel to a longitudinal direction of a respective sub-channel 402*a-d*. When a second microfluidic channel 202 is coupled into the connecting interface 404*a*, fluid from the second microfluidic channel 202 is thereby allowed to flow into the slits 108*a-d* from where the fluid flows to a respective one of the plurality of sub-channels 402*a-d*.

In the above described embodiments, the slits were arranged in parallel. FIGS. 6A-6C, FIG. 7 and FIG. 8 illustrate embodiments where this is not the case.

Figure 6A:
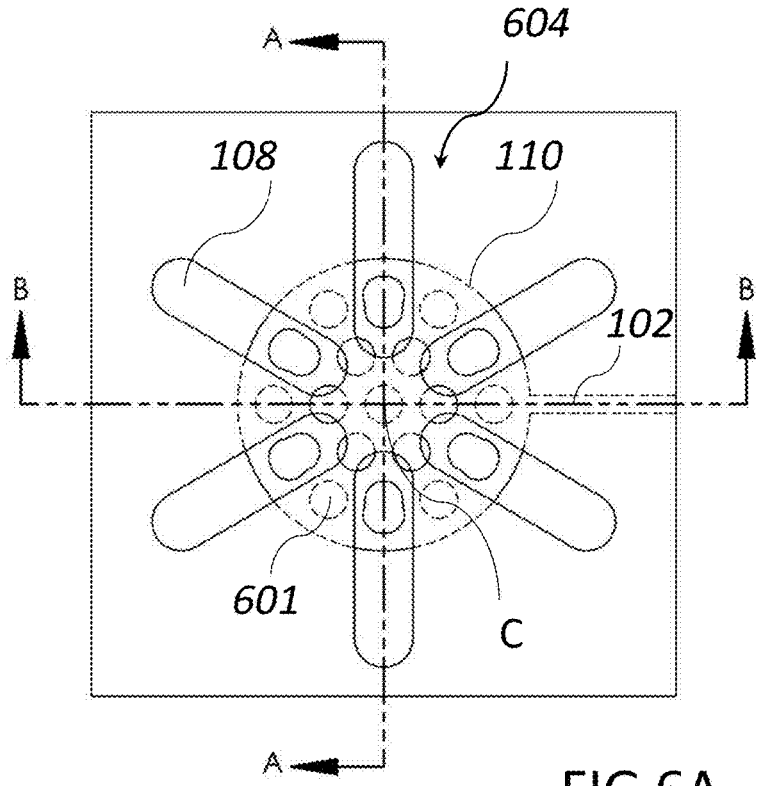
FIG. 6A is a top view of a connecting interface according to embodiments.
Figure 6B:
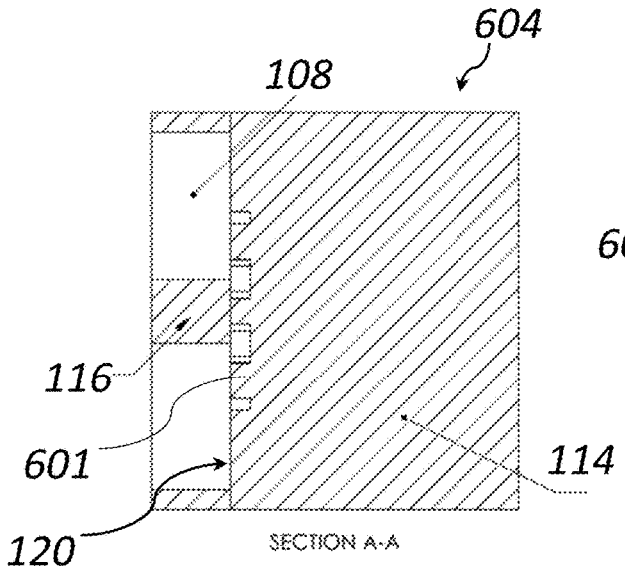
FIG. 6B is a cross-sectional view along section A-A of the connecting interface of FIG. 6A according to embodiments.
Figure 6C:
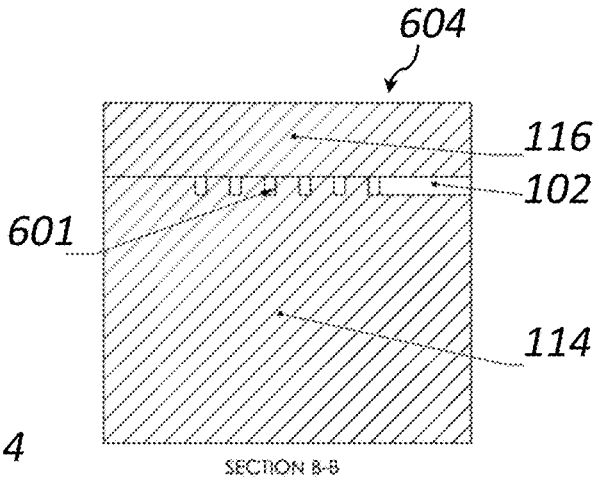
FIG. 6C is a cross-sectional view along section B-B of the connecting interface of FIG. 6A according to embodiments.

FIGS. 6A-6C illustrate a connecting interface 604. Similar to the connecting interfaces described above, the connecting interface 604 comprises a first microfluidic channel 102 and a plurality of slits 108. The first microfluidic channel 102 forms a chamber at the connecting region 110 as described above. The illustrated chamber has a circular shape as seen in a plane parallel to the outer surface 120 of the second substrate 116. In order to obtain a reasonably high capillary pressure for capillary-driven flows with a low flow resistance, an array of micropillars 601 may be arranged in the connecting region 110, i.e., in the chamber. The plurality of slits 108 are arranged in a radial pattern. More specifically, the plurality of slits 108 extends outside the connecting region 110 along radial directions in relation to a center C of the connection region 110. Each slits 108 hence extends beyond the circular shape of the connection region 110 along a radial direction. In FIGS. 6A-6C each slit is elongated in a direction parallel to the outer surface 120 and hence has a straight shape.

Figure 7:
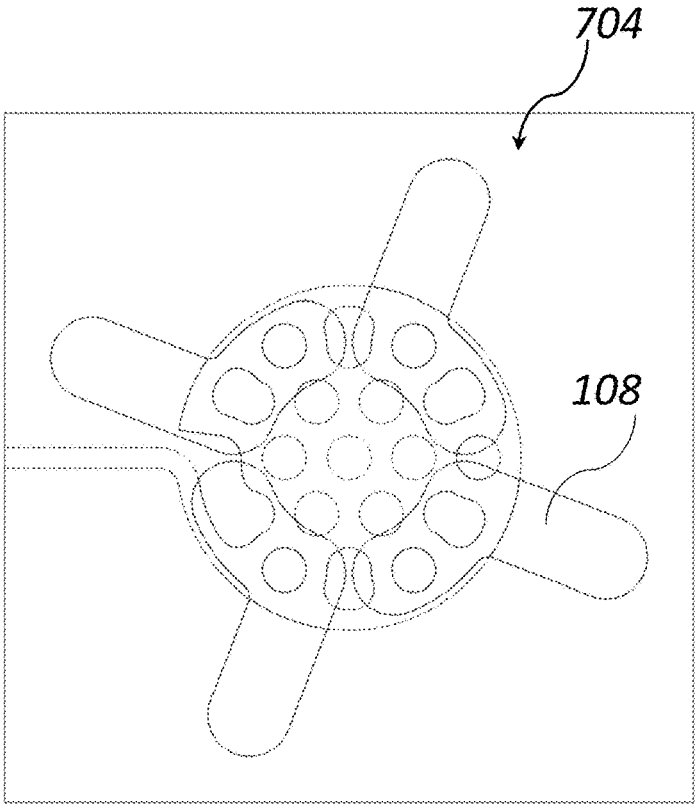
FIG. 7 is a top view of a connecting interface according to embodiments.
Figure 8:
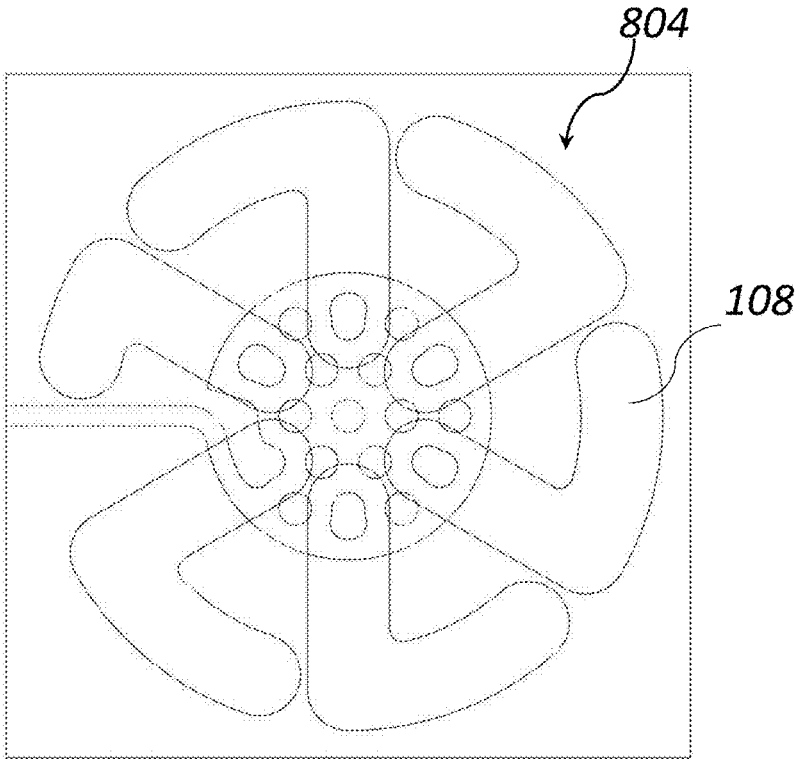
FIG. 8 is a top view of a connecting interface according to embodiments.

FIGS. 7 and 8 illustrate connecting interfaces 704 and 804, respectively. The connecting interfaces 704 and 804 differs from the connecting interface 604 of FIGS. 6A-6C in that the plurality of slits 108 are curved along the outer surface 120. It is to be understood that different curved shapes may have different advantages when it comes to making the connection interface less sensitive to misalignments, reducing the amount of fluid consumed by the slits, and reducing the flow resistance at the interface. FIGS. 7 and 8 illustrate two examples, although many variations are possible depending at the application at hand. It is further understood that slits having a curved shape are generally possible, not only for slits being arranged in a radial pattern. In fact, the slits shown in any of the examples above could be arranged to have a curved instead of a straight shape.

The embodiments herein are not limited to the above described examples. Various alternatives, modifications and equivalents may be used. Therefore, this disclosure should not be limited to the specific form set forth herein. This disclosure is limited only by the appended claims and other embodiments than the mentioned above are equally possible within the scope of the claims.

What is claimed is:

1. A connecting interface for capillary driven fluidically interconnecting microfluidic channels, the connecting interface comprising one or more substrates which collectively define:

a first microfluidic channel which includes a connecting region for fluidically connecting the first microfluidic channel to a second microfluidic channel, at least one slit in an outer surface of one of the one or more substrates, the at least one slit having an elongated shape and a longitudinal direction parallel to the outer surface, wherein the at least one slit provides a fluid passage from the outer surface to the connecting region of the first microfluidic channel and the at least one slit has at least one dimension extending beyond the connecting region along a direction parallel to the outer surface, wherein the connecting region is an intersection between the first microfluidic channel and the at least one slit, and wherein the first microfluidic channel has a longitudinal direction parallel to the outer surface.

2. The connecting interface of claim 1, wherein the one or more substrates comprise:

a first substrate which includes the first microfluidic channel, wherein the connecting region of the first microfluidic channel is arranged in a first surface of the first substrate, and a second substrate being arranged on the first surface, wherein said at least one slit is arranged in an outer surface of the second substrate to provide a fluid passage between the outer surface of the second substrate to the connecting region of the first microfluidic channel in the first substrate.

3. The connecting interface of claim 1, wherein the first microfluidic channel and the at least one slit are defined in the same substrate.

4. The connecting interface of claim 1, wherein the at least one slit is a plurality of slits.

5. The connecting interface of claim 4, wherein the plurality of slits are arranged in parallel.

6. The connecting interface of claim 1, wherein a longitudinal direction of the at least one slit is parallel to a longitudinal direction of the first microfluidic channel at the connecting region.

7. The connecting interface of claim 1, wherein a longitudinal direction of the at least one slit forms an angle in relation to a longitudinal direction of the first microfluidic channel at the connecting region.

8. The connecting interface of claim 1, wherein the first microfluidic channel is branched into a plurality of sub-channels, wherein the connecting region is defined by an intersection between the at least one slit and the plurality of sub-channels.

9. The connecting interface according to claim 8, wherein there are a plurality of slits in the outer surface, and wherein each sub-channel of the plurality of sub-channels is associated with a respective slit which provides a fluid passage between the outer surface and the sub-channel and which extends in a direction parallel to a longitudinal direction of the sub-channel.

10. The connecting interface of claim 8, wherein there are a plurality of slits in the outer surface, and wherein each slit extends across each one of the plurality of sub-channels.

11. The connecting interface of claim 4, wherein the plurality of slits extends beyond the connecting region along radial directions in relation to a center of the connecting region.

12. The connecting interface of claim 11, wherein the connecting region has a circular shape in a cross-section parallel to the outer surface, and wherein the plurality of slits each extends beyond the circular shape along one of said radial directions.

13. The connecting interface of claim 1, wherein the first microfluidic channel includes a closed end, wherein the connecting region is arranged at the closed end.

14. The connecting interface of claim 1, wherein a portion of the first microfluidic channel at the connecting region has a first width and another portion of the first microfluidic channel outside the connecting region has a second, smaller, width, such that the first microfluidic channel forms a chamber at the connecting region.

15. The connecting interface of claim 1, wherein the connecting region includes a micropillar array.

16. The connecting interface of claim 1, wherein a longitudinal direction of the at least one slit is parallel to the outer surface.

17. The connecting interface of claim 1, wherein the at least one slit is curved along the outer surface.

18. A microfluidic connection for fluidically interconnecting microfluidic channels, the microfluidic connection comprising:

the connecting interface of claim 1, and a further substrate including a second microfluidic channel arranged at said outer surface to intersect said at least one slit for fluidically connecting the second microfluidic channel to the first microfluidic channel.

19. The microfluidic connection according to claim 18, further comprising:

an adhesive layer arranged between said outer surface and the further substrate, wherein the adhesive layer has an opening overlapping at least a portion of the at least one slit in the outer surface for fluidically connecting the first microfluidic channel to the second microfluidic channel.

20. A diagnostic device comprising the connecting interface of claim 1.

21. A diagnostic device comprising the microfluidic connection of claim 18.

* * * * *